US005988021A

United States Patent [19]

Nicolosi et al.

[11] Patent Number: 5,988,021

[45] Date of Patent: Nov. 23, 1999

[54] SHINGLE REMOVING APPARATUS

[76] Inventors: Michael Nicolosi; William L. Bridge, Jr., both of 20 Doral Court, Marlton, N.J. 08053

[21] Appl. No.: 09/121,642

[22] Filed: Jul. 23, 1998

[51] Int. Cl.[6] ..... E04D 15/00

[52] U.S. Cl. ..... 81/45

[58] Field of Search ..... 81/45; 299/37.1; 30/169, 170; 254/131

[56] References Cited

U.S. PATENT DOCUMENTS

| | | | |
|---|---|---|---|
| 3,885,688 | 5/1975 | Larsen | 254/131 |
| 4,663,995 | 5/1987 | Amundson et al. | 81/45 |
| 4,763,547 | 8/1988 | Dike, Jr. | 81/45 |
| 4,858,503 | 8/1989 | Dike, Jr. | 81/45 |
| 5,001,946 | 3/1991 | Shirlin et al. | 81/45 |
| 5,741,047 | 4/1998 | Ordonez | 81/45 |
| 5,819,603 | 10/1998 | Murray | 81/45 |
| 5,863,100 | 1/1999 | Martin | 81/45 |
| 5,893,611 | 4/1999 | Gamber | 81/45 |

*Primary Examiner*—David A. Scherbel
*Assistant Examiner*—Lee Wilson
*Attorney, Agent, or Firm*—Henderson & Sturm

[57] ABSTRACT

A shingle removing apparatus 10 including an elongated handle member 20 connected on one end 21 to source of compressed gas 100 and provided with a trigger mechanism 22, wherein the other end 23 of the handle member 20 is provided with a framework element 24 which is further provided with a roller 30 and operatively associated with a lifter unit 13 and wherein the operation of the lifter unit 13 is governed both by the trigger mechanism 22 and a trip switch 50 operatively associated with the framework element 24.

8 Claims, 3 Drawing Sheets

SHINGLE REMOVING APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

Description of Related Art

As can be seen by reference to the following U.S. Pat. Nos. 4,663,995; 4,763,547; 4,858,503; and 5,001,946, the prior art is replete with myriad and diverse shingle removing devices.

While all of the aforementioned prior art constructions are more than adequate for the basic purpose and function for which they have been specifically designed, they are uniformly deficient with respect to their failure to provide a simple, efficient, and fail safe trigger safety arrangement that will insure that the shingle lifting blade is not activated until such time that the blade is positioned at the desired location to effect the removal of the shingles.

As any roofer is all too well aware, while mechanical shingle removing devices substantially reduce the amount of physical exertion that is required to strip shingles from a roof, they are also cumbersome to maneuver on a roof surface and do not have any built in safety devices to insure that the lifting blade will only be actuated at the precise moment that the blade is positioned to produce positive results.

As a consequence of the foregoing situation, there has existed a longstanding need for a new and improved shingle removing apparatus that has a trip switch coupled to the conventional compressed air trigger mechanism to prevent the inadvertent actuation of the shingle lifting blade, and the provision of such a construction is a stated objective of the present invention.

BRIEF SUMMARY OF THE INVENTION

Briefly stated, the shingle removing apparatus that forms the basis of the present invention comprises in general, a handle unit, a roller unit, and a shingle lifter unit. The roller unit is disposed on the lower end of the handle unit and operatively associated with the shingle lifter unit.

As will be explained in greater detail further on in the specification, the roller unit is operatively connected to the handle unit in such a way that the conventional compressed gas trigger mechanism on the upper portion of the handle unit is further controlled by a trip switch operatively associated with the roller unit such that the roofer must apply a downward force on the handle unit to vertically displace the roller unit relative to the handle member to actuate the trip switch and permit the normal operation of the compressed gas trigger mechanism.

In this manner the roofer can use the roller unit to easily maneuver the shingle removing apparatus on the roof surface without worrying about any accidental activation of the shingle lifter unit until such time as the apparatus is properly positioned. Then, in order to activate the shingle lifter unit, the trigger mechanism must be engaged while a downward force is being exerted on the handle unit to actuate the trip switch and energize the shingle lifter unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
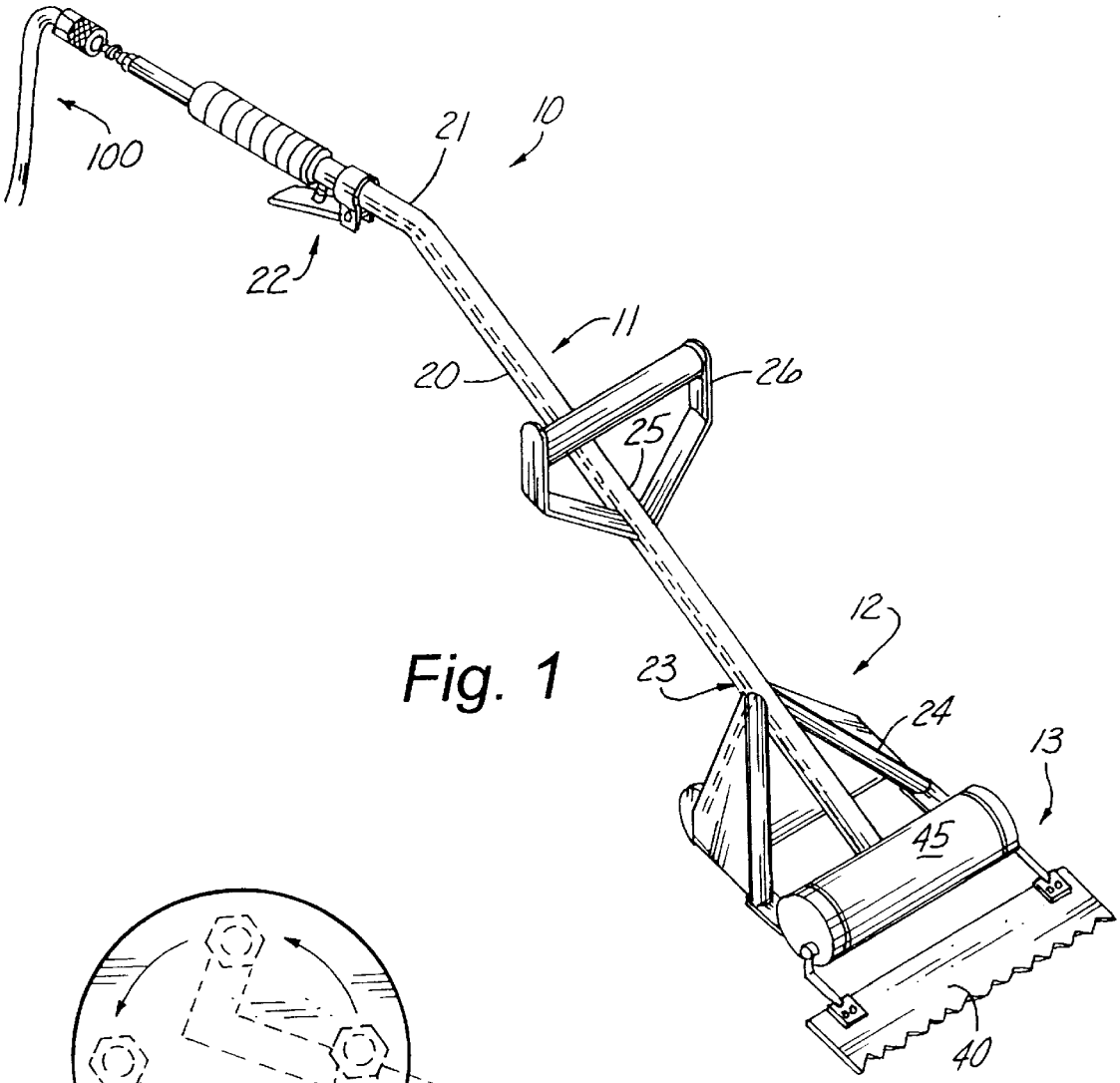
FIG. 1 is a perspective view of the shingle removing apparatus that forms the basis of the present invention.

As can be seen by reference to the drawings, and in particularly to FIG. 1, the shingle removing apparatus that forms the basis of the present invention is designated generally by the reference number 10. The apparatus 10 comprises in general, a handle unit 11, a roller unit 12, and a lifter unit 13. These units will now be described in seriatim fashion.

As shown in FIG. 1, the handle unit 11 comprises an elongated hollow tubular handle member 20 wherein the inboard end 21 of the handle member 20 is adapted to be connected to a source 100 of compressed gas and is provided with a trigger mechanism 22 for allowing the compressed gas to flow through the handle member 20 in a well recognized fashion.

In addition, the outboard end 23 of the handle member is provided with a framework element 24 which is operatively associated on one end with the roller unit 12 and operatively associated on the other end with the lifter unit 13 as will be explained presently.

Furthermore, the intermediate portion 25 of the handle member 20 is provided with a hand grip element 26 to facilitate the user in positioning the lifting unit 13 at a desired location on a roof.

Figure 3A:
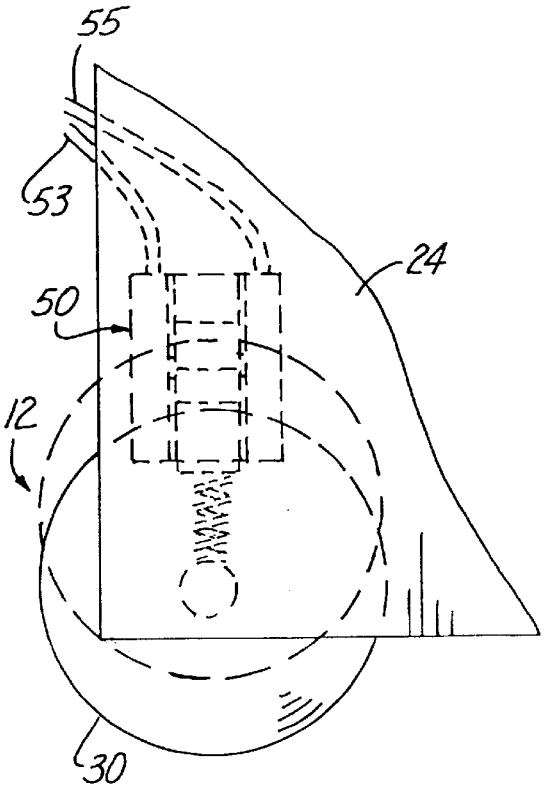
FIG. 3A is an isolated detail view of the roller mounted safety switch arrangement employed in the apparatus.
Figure 3B:
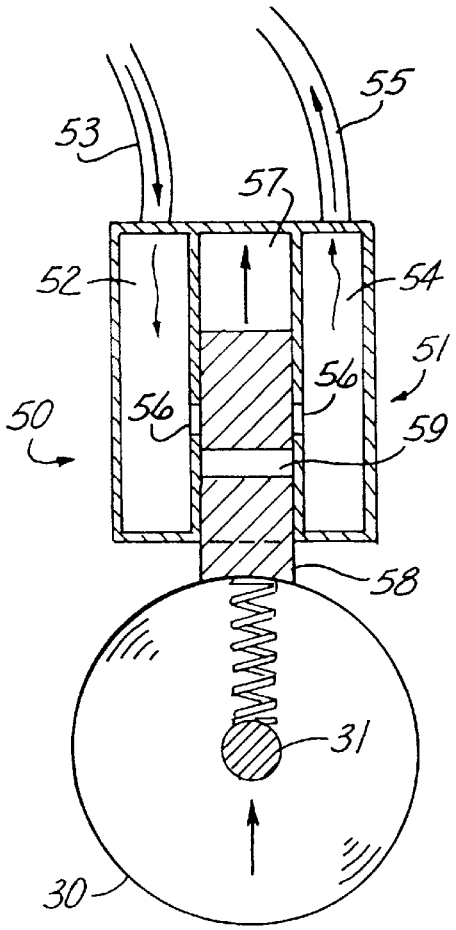
FIG. 3B is a cross sectional view showing the pressure porting arrangement within the safety switch.

As shown in FIGS. 3A and 3B, the roller unit 12 comprises a roller member 30 having a floating axle 31 suspended within the framework 24 to allow the roller member 30 to be vertically displaced relative to the framework 24.

Figure 4:
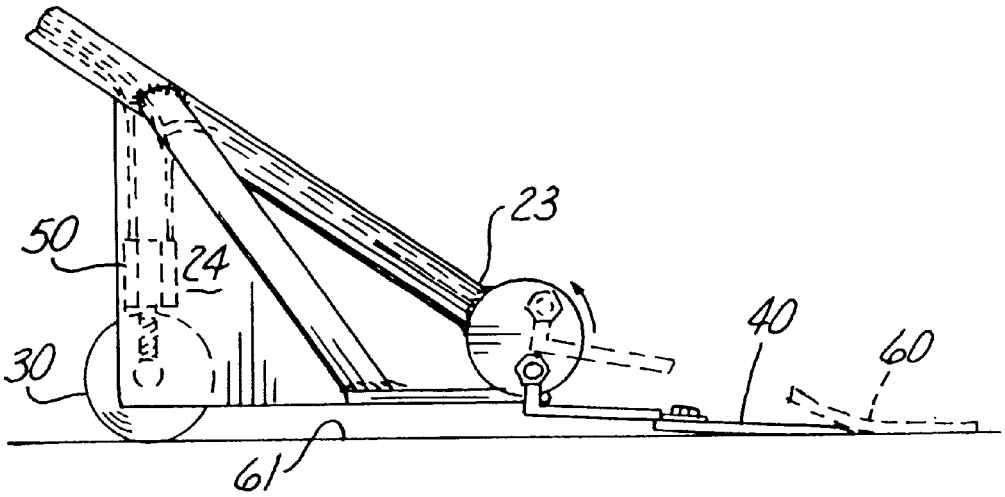
FIG. 4 is a side elevation view of the apparatus in use.

As can best be seen by reference to FIGS. 3A, 3B and 4, the framework member 24 is further provided with a pressure trip switch mechanism designated generally as 50 which comprises a compartmented multi chamber housing 51 having a pressure inlet chamber 52 provided with a high pressure inlet line 53 and a pressure outlet chamber 54 connected to a high pressure outlet line 55. Both the pressure inlet chamber 52 and the pressure outlet chamber 54 are provided with opposed ports 56 which communicate with a central piston chamber 57 which contains a spring biased piston element 58 having a central port 59 that is normally biased away from registry with the opposed ports 56 to block fluid communication from the pressure inlet chamber 52 to the pressure outlet chamber 54.

However, as can best be appreciated by reference to FIG. 3B as the floating axle 31 moves upwardly in the direction of the arrow it will force the central port 59 of the piston element 58 into registry with the opposed ports 56 to open communication between the inlet chamber 52 and the outlet chamber 54.

As can best be appreciated by reference to FIGS. 1, and 4, the roller member 30 is used to transport the apparatus 10 along the roof surface to a desired location; however, in order to deliver compressed gas through the outboard end of the handle member 20 the hand grip element 26 must be grasped and forced downwardly to raise the floating axle 31 on the roller member 30 into contact with the safety trip switch 50 whereby the actuation of the trigger mechanism 22 can be effectively employed to deliver the compressed gas to the lifter unit 13.

Figure 2:
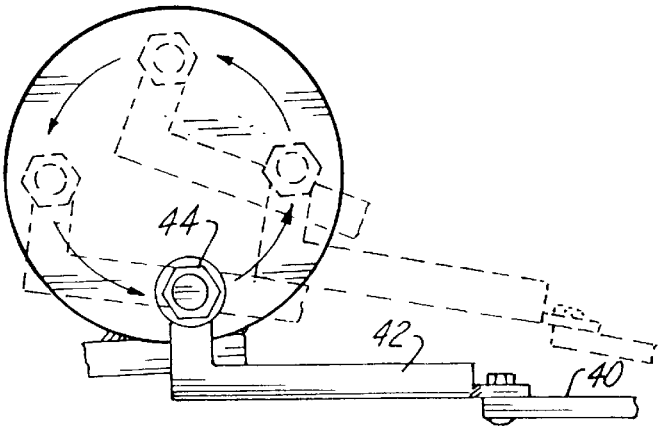
FIG. 2 is an isolated detail view of the rotary drive arm arrangement employed in the apparatus.
Figure 5:
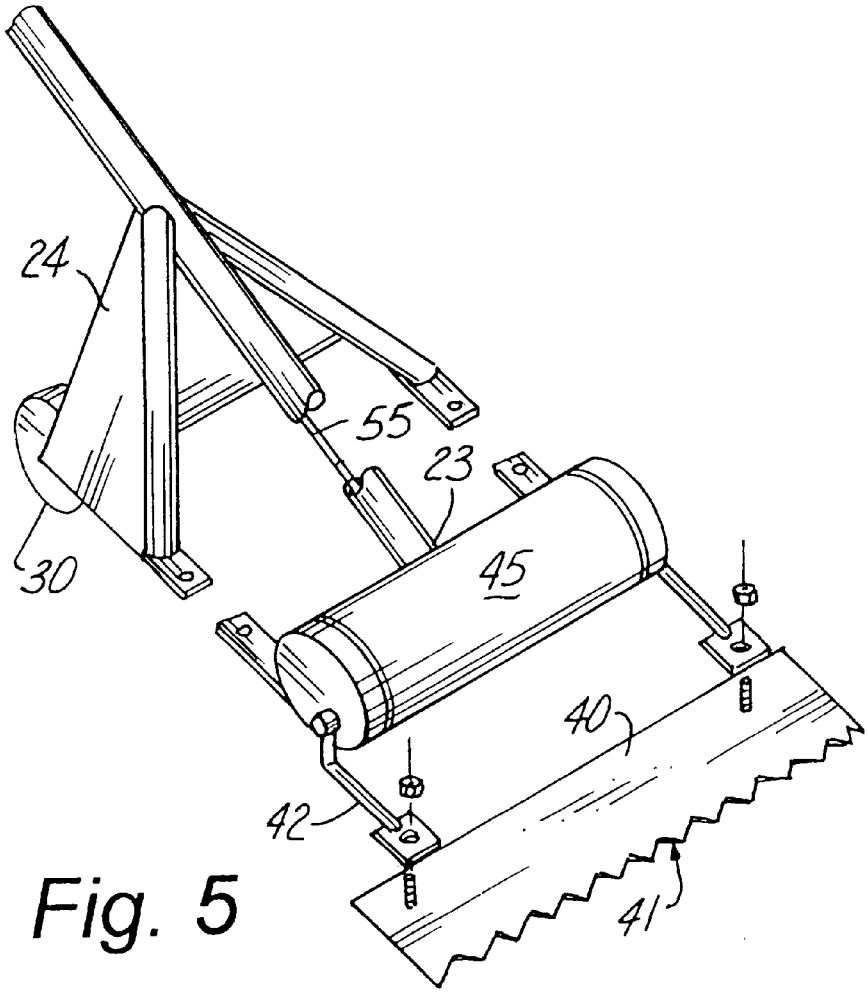
FIG. 5 is an exploded perspective view of the front portion of the apparatus.

Turning now to FIGS. 2, 4, and 5, it can be seen that the lifter unit 13 comprises in general, a lifter blade 40 having a serrated leading edge 41. The trailing end of the lifter blade 40 is provided with a pair of generally L-shaped lifter arms 42.

In addition, the inboard ends of the lifter arms 42 are pivotally connected to rotatable end caps 44 that are mounted on the opposite ends of a pneumatically charged cylinder 45 having an internal mechanism (not shown) for imparting counter clockwise rotating movement to the end caps 44 to force the leading edge 41 of the lifting blade 40 under the shingles 60 and then upwardly to detach the shingles 60 from the surface of a roof 61.

By now it should be appreciated that the shingle removing apparatus 10 of this invention may be easily maneuvered on a roof surface 61 by virtue of the roller 30 to position the leading edge 41 of the lifter blade 40 under a shingle 60. Then once the lifter blade 40 is in place, the operator will force the handle member 20 downwardly by use of the hand grip element 26 thereby depressing the floating roller axle 31 upwardly relative to the framework element 24 to activate the trip switch 50 and enable the handle trigger mechanism to deliver compressed gas to the pneumatically charged cylinder 45.

The compressed gas entering the cylinder 45 will then cause the end caps 44 to rotate thereby imparting a lifting motion to the lifter blade 40 to detach the shingles 60 from the roof 61 in a well recognized manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A shingle removing apparatus for removing shingles from a roof wherein the apparatus comprises:

a handle unit including an elongated hollow handle member having: an inboard end operatively connected to a source of compressed gas and provided with a trigger mechanism for introducing the compressed gas into the handle member; an outboard end provided with a framework element; and, an intermediate portion provided with a hand grip element;

a roller unit including a roller member operatively associated with the framework element for moving the apparatus across the surface of thereof; wherein, the roller member is vertically displaceable relative to the framework element;

a shingle lifter unit operatively associated with the framework element and comprising a pneumatically charged cylinder operatively connected to the outboard end of the handle member and provided with a pair of rotating end caps that are connected to a pair of contoured lifter arms operatively associated with a lifter blade; and, a trip switch operatively associated with the trigger mechanism to override the trigger mechanism until the trip switch is actuated; wherein, the trip switch is also operatively associated with the framework element whereby the vertical displacement of the roller member relative to the framework element will trigger the trip switch.

2. The apparatus as in claim 1 wherein the trip switch is mounted on the framework element.

3. The apparatus as in claim 2 wherein the roller member is provided with a floating axle which is vertically displaceable relative to the framework element.

4. The apparatus as in claim 3 wherein said trip switch is mounted on the framework element above said floating axle.

5. The apparatus as in claim 4 wherein the trip switch comprises a multi chamber housing having a pressure inlet chamber and a pressure outlet chamber disposed on opposite sides of a piston chamber.

6. The apparatus as in claim 5 wherein the pressure inlet chamber is operatively connected to a source of pressurized gas, and the pressure outlet chamber is operatively connected to said pneumatically charged cylinder.

7. The apparatus as in claim 6 wherein the trip switch further comprises a piston element slidably disposed in the piston chamber and operatively associated with the roller member.

8. The apparatus as in claim 7 wherein the pressure inlet chamber and the pressure outlet chamber are provided with ports which communicate with said piston chamber wherein the position of the piston element controls the flow of pressurized gas from said pressure inlet chamber to said pressure outlet chamber.

* * * * *